US005355759A

United States Patent [19]

Hoshino

[11] Patent Number: 5,355,759

[45] Date of Patent: Oct. 18, 1994

[54] HOLDING STRUCTURE FOR GUITAR STRINGS

[75] Inventor: Yoshiki Hoshino, Aichi, Japan

[73] Assignee: Hoshino Gakki Co., Ltd., Japan

[21] Appl. No.: 104,367

[22] Filed: Aug. 9, 1993

[30] Foreign Application Priority Data

Nov. 11, 1992 [JP] Japan ..... 4-084308[U]

[51] Int. Cl.[5] ..... G10D 3/04

[52] U.S. Cl. ..... 84/298; 84/307

[58] Field of Search ..... 84/297 R, 298, 299, 84/307

[56] References Cited

U.S. PATENT DOCUMENTS

| | | | |
|---|---|---|---|
| 4,031,799 | 6/1977 | Fender | 84/307 |
| 4,128,033 | 12/1978 | Petillo | 84/299 |
| 4,281,576 | 8/1981 | Fender | 84/298 |
| 4,541,320 | 9/1985 | Sciuto | 84/298 |
| 4,625,613 | 12/1986 | Steinberger | 84/298 |

*Primary Examiner*—Michael L. Gellner
*Assistant Examiner*—Patrick J. Stanzione
*Attorney, Agent, or Firm*—Ostrolenk, Faber, Gerb & Soffen

[57] ABSTRACT

A structure for holding a guitar string including a base plate at the guitar body near the bridge, a saddle above the base plate, a saddle height position adjusting screw and a front-back position adjusting screw for the saddle. The latter screw is held in a groove in a holding member. The holding member is rotatable in a fixed member on the base plate. The rotatability of the holding member enables the height of the saddle to be set, with corresponding adjustment in the tilt angle of the front-back position adjustment screw and the holding body in the hole. A screw clamps a holding part against the front-back position adjusting screw and to also clamp the holding part at a selected rotative position to which the holding part has been adjusted in conformity with the height of the saddle.

10 Claims, 5 Drawing Sheets

HOLDING STRUCTURE FOR GUITAR STRINGS

BACKGROUND OF THE INVENTION

This invention relates to a structure for holding guitar strings at a guitar bridge and particularly at the tremolo.

A prior art structure for holding guitar strings is shown in FIGS. 7 through 9. A guitar 80 has a body 81 on which strings 83 are supported. One end of each string 83 is installed on a tuning peg or bolt 84 on a head at the end of a neck 82. The other end of the string is installed on a bridge 85 supported on the body 81 and the string is stretched between its supports.

A bridge plate 86 having a cross section in the shape of an L, as shown in FIG. 9, is included in the bridge 85. A string saddle 87 which adjusts the height, position and length (tension) of each string 83 is also arranged on the plate 86. The height of the saddle 87 is adjustable by a height position adjusting screw 89 which rests on the bridge plate and passes vertically and threadedly through the saddle 87. Rotation of the screw 89 moves the saddle 87 up or down. The forward and back position of the saddle 87 can be adjusted by rotating the adjusting screw 88 which passes horizontally and threadedly through the saddle. The head end 88A of the screw is engaged with the stand-up portion 86A of the bridge plate 86, while the tension of the string 83 urges the saddle toward the guitar head, such that rotation of the screw 88 moves the saddle along the screw and in the front-back direction.

The string 83 is partly wrapped over a string holding part 90 on the upper peripheral surface of this saddle 87. The position of the saddle and the resulting height and length (intonation) of the string 83 are adjusted by suitably rotating the height position adjusting screw 89 and the front-back position adjusting screw 88.

In the prior art structure described above however, the stress of holding the saddle 87 in position is concentrated on the head 88A of the front-back position adjusting screw 88 supported to the stand-up part 86A of the bridge plate 86, in the final analysis. As the saddle height is raised or lowered by the height position adjusting screw 89, the screw 88 becomes tilted in incline and the engagement between the head 88A of the front-back position adjustment screw 88 and the stand-up part 86A of the bridge plate 86 thereby becomes tilted and may not be stable. These can cause shaking of the saddle due to the vibration energy of the strings during the course of the performance or could cause an erroneous string height or musical tone.

Furthermore, when all of the front-back position adjusting bolts 88 respectively for the various strings are engaged to the single stand-up part 86A that has been erected on the bridge plate 86, this restricts the design of the bridge part 85 making it difficult to uplift the design effect by free designing.

SUMMARY OF THE INVENTION

To overcome the above described problem, the invention provides a structure for firmly holding the guitar strings while enabling wide freedom in design for the bridge making the bridge easily capable of accommodating adjustments in whatever number of the strings that are employed.

The structure for holding guitar strings has a base plate which is arranged in the main body of a guitar. A saddle is supported above the base plate. One saddle may be provided for each string. There are front-back position adjusting screws which are engaged and operable for the various guitar strings. The saddle has a guitar string holding part. Height position adjusting screws may be screwed into a threaded opening in the saddle in the vertical direction. A front-back adjusting screw for the saddle includes an engaging head at the rear part which is screwed in the front-back direction. A holding member for the front-back position adjusting screw includes a main columnar body. A cut groove is formed from one terminal end face of the columnar main body. A holding part holds the front-back position adjusting screw which is inserted thereinto. The holding part is formed in the cut groove. A fixed member is fixed on the base plate for each of the saddles on the plate. The fixed member has a holding hole part which holds the position adjusting screw holding member in a rotatable manner. The fixed member also has an engaging part that engages the engaging head of the front-back position adjustment screw. A tightening screw tightens or loosens the cut groove of the front-back position adjusting screw holding member that has been inserted into the holding hole part being screwed thereto.

Other objects and features of the invention are explained below with reference to the drawings.

DESCRIPTION OF THE PREFERRED EMBODIMENTS

Figure 1:
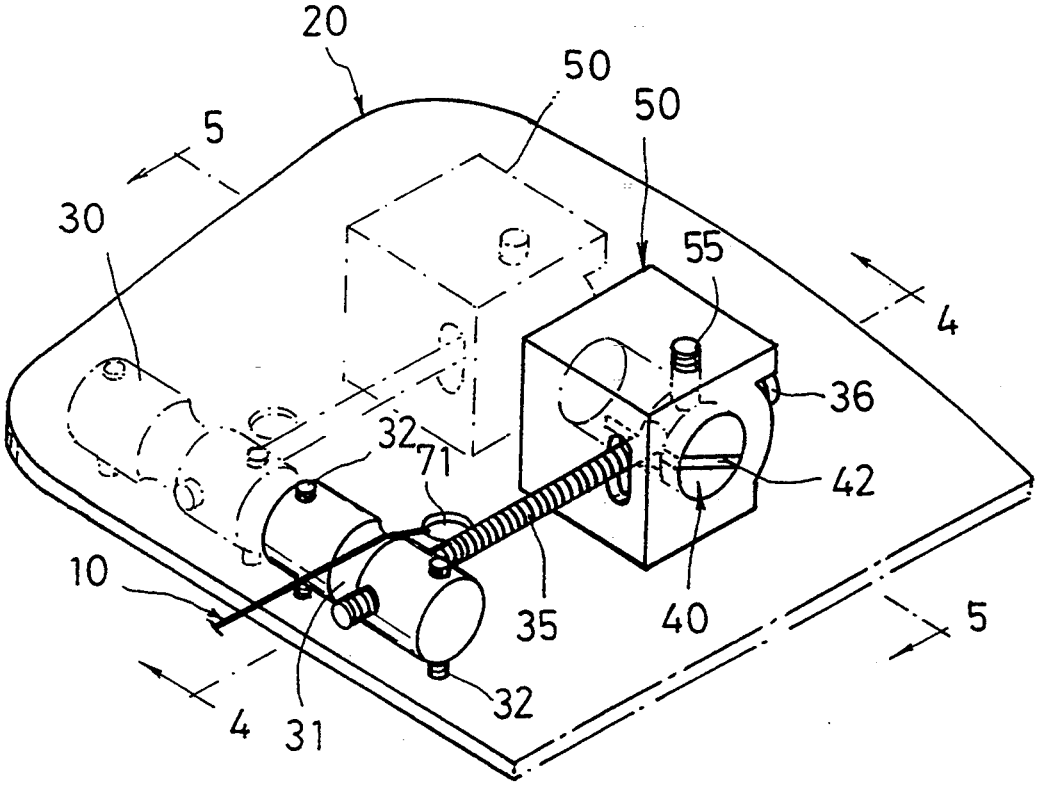
FIG. 1 is an oblique view of an example of a guitar string holding structure according to the invention.

FIG. 1 shows a guitar string holding structure comprising a base plate 20, a saddle 30, a front-back position adjusting member 40 and a fixed member 50.

The base plate 20 corresponds to a bridge plate in the prior art. It is made, for instance, of a flat metal board, and is arranged on the main body of the guitar.

Figure 6:
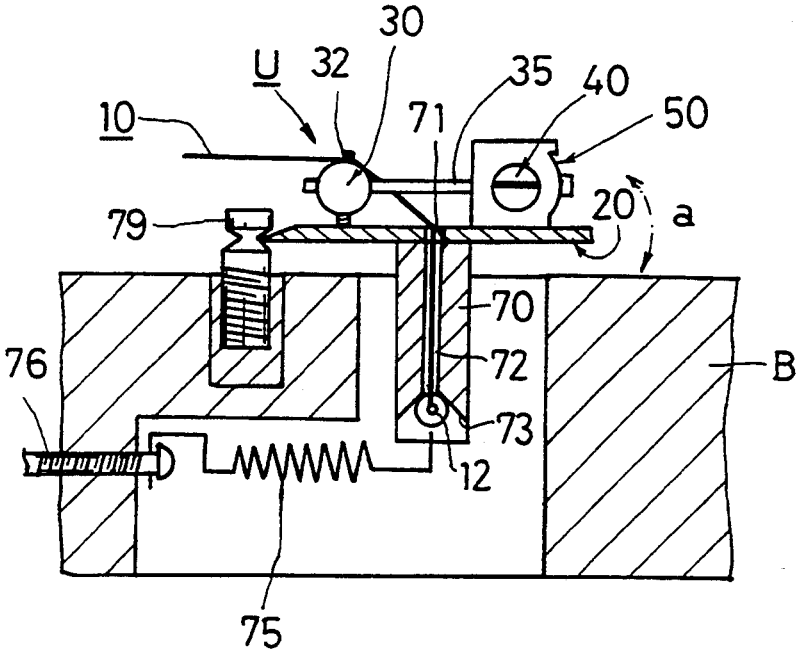
FIG. 6 is a cross section of the essential part showing how the structure is mounted on the body of a guitar.
Figure 9:
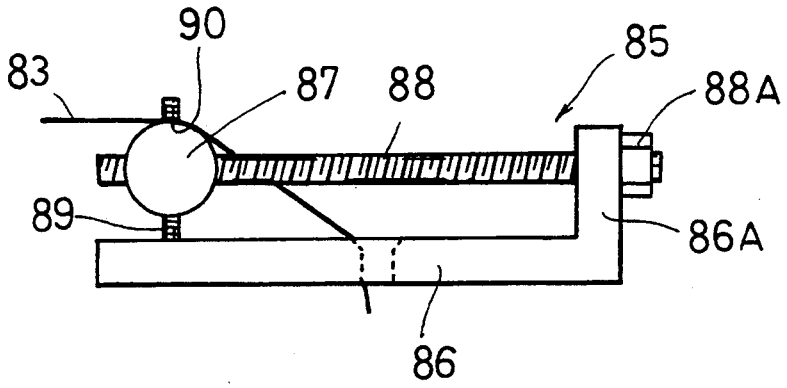
FIG. 9 is a cross section through an example of a prior art guitar.
Figure 7:
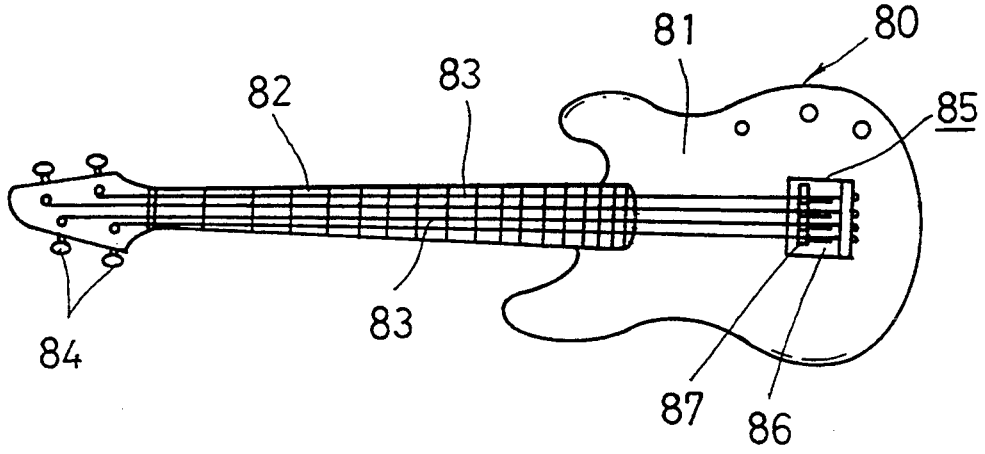
FIG. 7 is a plan view showing an example of a guitar according to the prior art.
Figure 8:
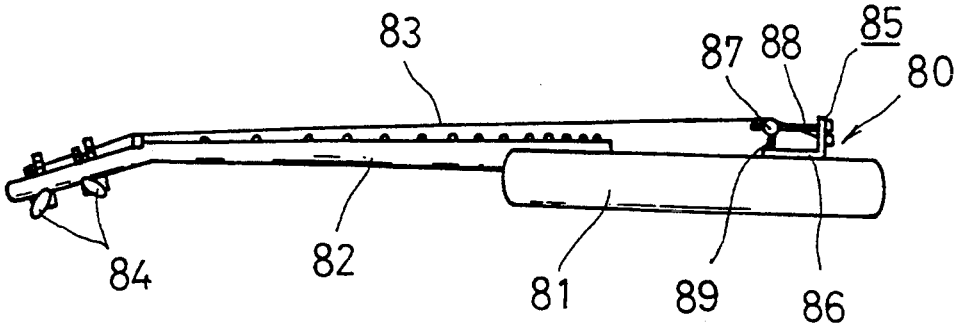
FIG. 8 shows a side view thereof.

The illustrated base plate 20 is part of a tremolo unit U, shown in FIG. 6, which includes a depending part 70 formed at the lower part of the base plate. The plate is held freely swingable generally in the vertical direction a inside the empty space S of the main body B. There is a through hole 71 provided in the base plate 20 for passage of a string 10. That continues to a string insertion part 72 in the depending part 70. A string stopper 12 engages the stopping end 73 of the depending part 70 to retain the end of the string. A lever, not shown, enables the player to tilt the base plate of the tremolo. A spring 75 for returning the tremolo to a correct upright position is connected between the insertion part 72 and the main body B by a fixing member 76. The engaging edge or tip of the base plate 20 engages the fulcrum pins 79, so that the plate 20 is swingable around the fulcrum.

Use of this invention is not restricted to the tremolo structure shown in FIG. 6 nor to use only with a tremolo. For instance, the base plate 20 may be applied directly to the guitar body.

A respective saddle 30 is placed across the guitar to receive each of the guitar strings 10 above the base plate 20. Each saddle 30 has a respective string holding part 31 comprising a peripheral groove.

Two saddle height adjusting screws 32 for adjusting the height of the saddle rest on the base plate and are screwed into respective threaded holes 33 that extend along the vertical direction and are located toward both ends of the saddle 30. Rotation of the respective screws adjusts the height of each saddle. A respective front-back position adjusting screw 35 for adjusting the front-back position of each saddle is screwed into a horizontal screw hole 34 along the front-back direction of the saddle 30. An engaging head 36 is formed at the rear part of the front-back position adjustment screw 35.

Figure 2:
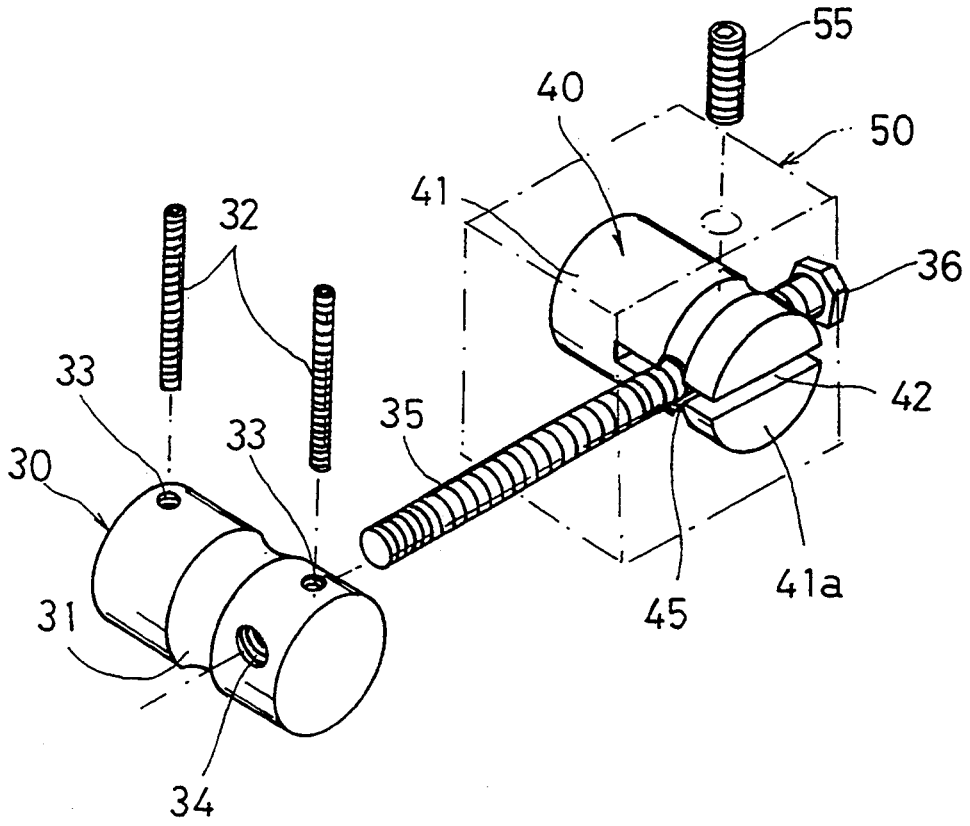
FIG. 2 is a dismantled oblique view of the saddle and the front-back position adjusting screw holding member.

FIG. 2 shows a front-back position adjusting screw holding member 40 which includes a columnar main body 41. A groove 42 is cut in from one terminal face 41*a* of the columnar body. There is a holding part 45 for receiving the front-back position adjustment screw 35 in the groove 42. The holding part 45 is operable either to fix or to hold the front-back position adjustment screw 35 in a free state due respectively to the compression or loosening of the groove 42. There is a tightening concave 46 for the groove positioned to be tightened down against the screw 35, as described below.

Figure 4:
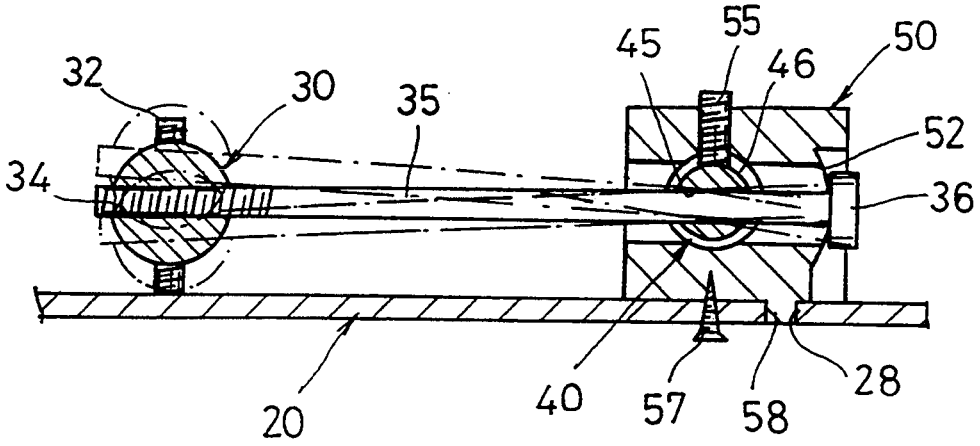
FIG. 4 is a cross section along line 4—4 in FIG. 1.
Figure 5:
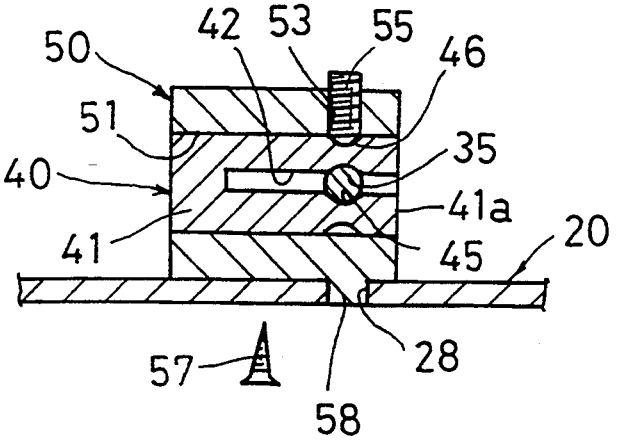
FIG. 5 is a cross section along line 5—5 in FIG. 1.

In FIG. 1, a respective fixed member 50 for each string is securely set on the base plate 20. Each one is placed for cooperating with a respective saddle for one of the strings 10 or for cooperating with a number of the strings independent of each other. In FIGS. 4 and 5, each fixed member 50 is fixed to the base plate by a screw 57 inserted from the reverse side or underside at a prescribed location on the base plate 20. A protrusion 58 for stopping rotation is inserted into a hole 28 in the base plate 20.

Figure 3:
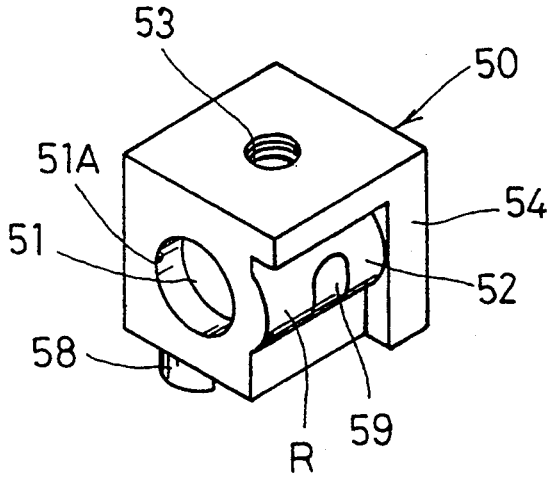
FIG. 3 is an oblique view of the fixed member.

In the oblique view of FIG. 3 and in the cross sections of FIGS. 4 and 5, which show the installed state, the fixed member 50 is equipped with a sideways extending holding hole 51 which holds the holding member 40 for the front-back position adjusting screw in a rotatable manner. The hole 51 freely rotatably holds the front-back position adjusting screw holding member 40. It has an inner peripheral surface 51A on which the main columnar body 41 of the adjusting screw holding member 40 slidingly rotates at least to prescribed angles.

At its rear end, an engaging part 52 of the fixed member 50 engages the engaging head 36 of the front-back position adjusting screw 35. Since the screw 35 extends in the saddle 30, it also swings vertically as the saddle moves in the vertical direction and this causes rotation of the screw holding member 40. To accommodate this, the rear part 52 of the fixed member 50 is defined by a hole 59, which is elongated in the vertical direction, as shown in FIG. 3.

It is preferable to shape the engaging part 52 as a curved surface R which extends generally in the vertical direction and has the screw holding member at its center, as shown in FIG. 3, for assuring the engagement of the engaging head 36 of the front-back positioning adjusting screw 35 as it moves in the up and down direction.

A tightening screw 55 is screwed into the screw hole 53 of the fixed member 50. This tightening screw 55 is rotated to either fix or freely movably hold the front-back position adjusting screw 35, which is being held in the holding part 45, by compressing or loosening the groove 42 of the front-back position adjusting screw holding member 40 that has been inserted into the holding hold 51 of the fixed member 50. Where the tightening concave 46 for tightening the cut groove is formed as described earlier, the tightening screw 55 is set at a position across the guitar corresponding to that of the tightening concave 46.

In the structure for holding guitar strings described above, the tightening screw 55 for the fixed member 50 is at first loosened, the groove 42 of the front-back position adjusting screw holding member 40 that has been inserted into its holding hole 41 is loosened, and the front-back position adjusting screw 35, which has been held by the holding part 45, is maintained in a free state for enabling adjustment of the height or length of the string.

When the height of the string is to be adjusted, further, the saddle 30 is adjusted to a prescribed height by rotating the height position adjusting screws 32 in the saddle 30, as shown in FIG. 4. The tip of the front-back position adjusting screw 35 that has been screwed into the saddle 30 is moved up or down. This in turn rotates the front-back position adjusting screw 40 in the holding hole 51 of the fixed member 50, and holds the screw 35 at the prescribed new tilt angle position.

After the height of a string is adjusted, the tightening screw 55 of the fixed member 50 is thereafter tightened, the groove 42 of the holding member 40 is compressed and the front-back position adjusting screw 35 is fixed. The front-back position adjusting screw 35 is firmly held to the holding part 45 by compression of the groove 42 of the holding member 40 along the engagement of the engaging head 36 at the rear engaging part 52 of the fixed member 50.

When the length of the string is also to be adjusted, the front-back position adjusting screw 35 is rotated in the saddle so that the screw 35 adjusts the front-back position of the saddle 30. Subsequent to the adjustment of the front-back position, the tightening screw 55 of the fixed member 50 is tightened, the groove 42 of the holding member 40 is compressed and the front-back adjusting screw 35 is fixed.

As has been explained above, the position of the saddle is secured by tightening and fixing the main front-back position adjusting screw by means of the holding part of the holding member, which holding member was freely rotatably held in the fixed member, coupled with the engagement between the engagement head of the front-back position adjusting screw and the fixed member. Securement of all of these elements is firm and secure.

The secured position of the saddle is no longer concentrated on the head of the front-back position adjusting screw which is engaged with the bridge plate as its engaged state is also stabilized. Thus, the saddle will not become shaky during a performance and there will be no errors in the musical tuning or in the height of the strings, with the result that the strings can be securely held.

According to the invention, the fixed member can be independently set for each string. This provides considerable freedom for design at the bridge, thereby improving its design. Furthermore, a change in the number of strings can be easily handled.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A structure for holding a guitar string in the region of a bridge of a guitar, comprising:

a base plate supported in the region of the bridge of the guitar;

a saddle disposed above the base plate and positioned so that the guitar string is supported to pass over the saddle such that the saddle may adjust the height of the string at the saddle and/or may adjust the tension on the string;

saddle height adjusting means extending from the base plate to the saddle and operable for adjusting the height of the saddle above the base plate;

means for adjusting the front to back position of the saddle with respect to the base plate, comprising:

a first screw to be threaded into the saddle generally in the front-back direction, the first screw having a head that is behind and spaced away from the saddle;

a fixed member fixed on the base plate behind the saddle for supporting the first screw, the fixed member having a hole in it extending across the direction of extension of the string;

a holding member for holding the first screw, the holding member having a body that is supported in the hole of the fixed member and that is rotatable with respect to the fixed member in the hole; a groove in the body of the holding member, a holding part of the body being positioned at the groove to hold the first screw inserted into the groove;

an engaging part on the fixed member for engaging the head of the first screw which determines the forward position of the first screw and of the saddle on the first screw;

fixing means in the fixed member for holding the first screw in the tilted position with respect to the fixed member which tilted position is established by the saddle height position adjusting means.

2. The structure of claim 1, wherein the engaging part of the fixed member is a convexly curved surface shaped so that the head of the first screw engages the curved surface to maintain a selected front-back position for the saddle as the height of the saddle is adjusted by the saddle height adjusting means and the first screw and by the holding member rotating in the hole in the fixed member.

3. The structure of claim 1, wherein the saddle height adjusting means comprises a screw which rests in the base plate and is screwed into the saddle in a vertical direction such that rotation of the saddle height adjusting means screw adjusts the height of the saddle above the base plate.

4. The structure of claim 1, wherein the groove in the body of the holding member is a cut in from one terminal end face up the body.

5. The structure of claim 1, wherein the fixing means is operable for selectively tightening or loosening the holding part for the first screw.

6. The structure of claim 5, wherein the fixing means comprises a second screw in the fixed member and extending into contact with the holding part such that tightening of the second screw presses the holding part against the first screw, while loosening the second screw loosens the grip of the holding part on the first screw for permitting adjustment of the first screw by rotation thereof for permitting movement of the saddle in the front-back direction.

7. The structure of claim 5, wherein the fixing means both secures the first screw against rotation and therefore fixes the front-back position of the saddle and also prevents rotation of the holding member at the selected height of the saddle.

8. The structure of claim 1, wherein the hole in the fixed member for receiving the holding member is a round hole, and the holding member is round and engages the fixed member in the hole for the holding member to be rotatable in the hole.

9. The structure of claim 1, wherein there are a plurality of guitar strings, a respective one of the saddles for each of the strings, a respective one of the fixed members for each of the strings, a respective one of the height position adjusting means for each saddle and a respective first screw for each saddle.

10. A structure for holding a guitar string in the region of a bridge of a guitar, comprising:

a base plate supported in the region of the bridge of the guitar;

a saddle disposed above the base plate and positioned so that the guitar string is supported to pass over the saddle such that the saddle may adjust the height of the string at the saddle and/or may adjust the tension on the string;

saddle height adjusting means extending from the base plate to the saddle and operable for adjusting the height of the saddle above the base plate;

means for adjusting the front to back position of the saddle with respect to the base plate, comprising:

means including a part in engagement with the saddle and operable for moving the saddle in the front-back direction;

a fixed member on the base plate behind the saddle for supporting the part, the fixed member having a hole in it extending across the direction of extension of the string;

a holding member for holding the part, the holding member having a body that is supported in the hole of the fixed member and that is rotatable with respect to the fixed member in the hole;

holding means in the body of the holding member to hold the part;

fixing means in the fixed member for engaging the holding member to hold the part in a tilted position with respect to the fixed member, which tilted position is established by the saddle height position adjusting means.

* * * * *